United States Patent [19]

Janzen et al.

[11] Patent Number: 4,458,934

[45] Date of Patent: Jul. 10, 1984

[54] HANDLES FOR SLIPS USED ON DRILLING RIGS

[75] Inventors: Harlo W. Janzen; Melvin J. Kliewer, both of Fairview, Okla.

[73] Assignees: Larry D. Kliewer; Glenn A. Kliewer, both of Fairview, Okla.

[21] Appl. No.: 356,840

[22] Filed: Mar. 10, 1982

[51] Int. Cl.[3] ..... A44B 21/00

[52] U.S. Cl. ..... 294/102 A

[58] Field of Search ..... 294/102 A, 74, 75, 76, 294/90, 91, 113, 86 R, 117; 16/DIG. 18, 19, 120, 114 R; 87/9

[56] References Cited

U.S. PATENT DOCUMENTS 1,501,962 7/1924 Montgomery ..... 294/102 A 4,232,619 11/1980 Lindahl ..... 294/74

*Primary Examiner*—James B. Marbert

*Attorney, Agent, or Firm*—William R. Laney

[57] ABSTRACT

Slips of the type used for gripping drill pipe and casing employed in the drilling of oil and gas wells are constructed with novel handles which are improved in terms of safety in use. The handles of the slips are elongated members having a hand grip loop at one end thereof and a pivot head at the other end thereof for attachment to the slip mechanism. Each handle is constructed of a body of molded or cast polyurethane having embedded therein a stranded or braided nylon core which extends throughout the length of the handle and also lies within the hand grip loop.

9 Claims, 6 Drawing Figures

HANDLES FOR SLIPS USED ON DRILLING RIGS

BACKGROUND OF THE INVENTION

1. Field of the Invention

This invention relates to handles which are constructed to provide special advantage when incorporated in the slips used on oil well drilling rigs for gripping and engaging sections of drill pipe and casing employed in drilling and completing the well.

2. Brief Description of the Prior Art

In the drilling of oil and gas wells, it is necessary to handle and move very heavy sections of joints of drill pipe and casing. It is necessary at times to grip an end portion of a section of drill pipe or casing at a location on the rig floor adjacent the rotary table in order to properly position the section of drill pipe or casing for connection to an adjacent length of drill pipe or casing, or to swing the drill pipe or casing from one location to another. Also, during the making of trips into and out of the well for replacing bits and for other reasons, the drill string or casing must often be suspended from the rotary table.

When drill pipe or casing is to be suspended in the well bore from the rotary table, it is the practice on drilling rigs to engage the upper end of the top section of drill pipe or casing with mechanical slip jaws of a wedge-shaped configuration, and then lower the pipe into the opening through the rotary table until the slip jaws, which carry teeth on the inner side thereof adjacent the drill pipe or casing, are wedged tightly against the tubular element by the rotary table, and thus suspend the tubular element in the well bore.

The slip elements used for the purpose described are generally heavy steel elements and two or three members of the rig crew are usually required to place the slips about the pipe and position the slips in the rotary table after the pipe is centered in the slips and is gripped thereby. These movements are accomplished with the aid of steel handles which are attached to opposite sides of the pivotally engaged slip jaws. Because of the weight of the slips, and more especially, the weight of the section of drill pipe or casing engaged by the slips prior to the weight of both slips and casing being taken by the rotary table, movement of the slips and engaged drill pipe section or casing is difficult, and a lack of agility or a careless movement on the part of a rig crewmen may result in a severe bruise or other injury when the slip handles strike the body. Moreover, in the case of drilling of oil and gas wells in very cold or very hot environments, the steel of the slip handles can become painful to touch and to grip, even when work gloves are worn by the crewmen, as is usually the case.

BRIEF DESCRIPTION OF THE PRESENT INVENTION

The present invention provides improved slip handles for attachment to slips employed on a drilling rig for the suspension of tubular elements, such as drill string and casing, from the rotary table.

The prior art which is known to me which appears to have any relationship to the handle of the present invention includes Chase, Jr. U.S. Pat. No. 3,078,755; Antell U.S. Pat. No. 3,276,810 and Brown U.S. Pat. No. 4,258,608. While the advantage of having a braided nylon core in a rope structure is recognized in the Chase patent, that patent does not deal with a semi-rigid handle having the hardness characteristics of the handle of the present invention, or having the possibility of usages in slip structures which constitute the principle environment for usage of the present invention.

Broadly described, the slip handles of the invention, which are usually employed in pairs, each includes an elongated shank element having a hand grip loop at one end thereof, and a bifurcated clevis or apertured pivot head at the other end thereof for engaging an apertured ear on one of the slip elements. The entire handle is molded of a body of polyurethane and has a centrally disposed core of stranded or braided nylon cord. The stranded nylon cord is doubled along the length of the handle shank, with the two runs of the cord diverging and passing in a single run around the circular portion of the handle which forms the hand grip loop.

The slip handle as thus constructed has the necessary strength to support the full weight of the slips without fracturing or breaking, yet is light in weight and is not rigid or excessively hard. The handle is susceptible to some yielding or bending and upon impacting the flesh or a part of the body does not bruise or injure the way the steel handles previously used have done. Moreover, the slip handles do not exhibit thermal conductively characteristics such that they become excessively heated or excessively cold when the drilling is being carried out in regions where extremes of temperature are encountered.

In addition to the described advantages, other objects and advantages of the invention will become apparent as the following detailed description of the invention is considered in conjunction with the accompanying drawings which illustrate the invention.

GENERAL DESCRIPTION OF THE DRAWINGS

DETAILED DESCRIPTION OF A PREFERRED EMBODIMENT OF THE INVENTION

Figure 1:
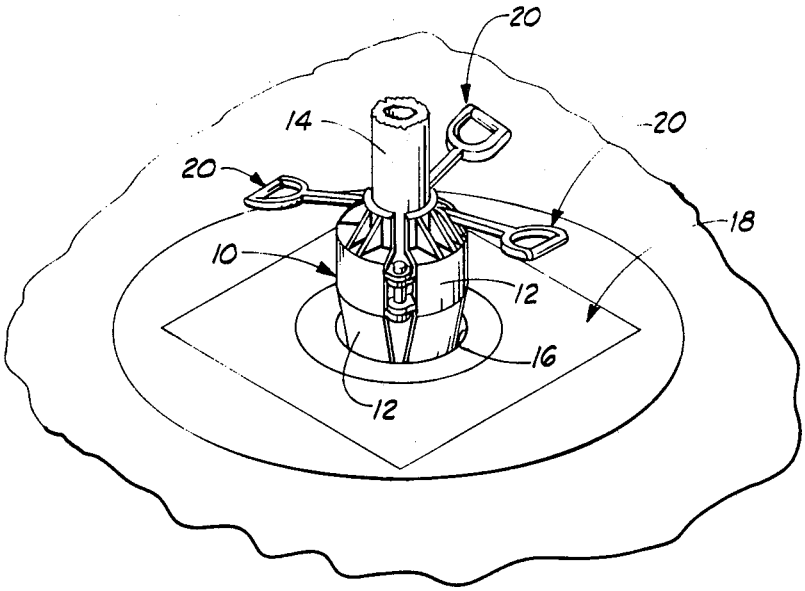
FIG. 1 is a perspective view of a set of slips as they appear in use for wedgingly suspending a tubing string from the rotary table of a drilling rig.

In FIG. 1 of the drawings a set of slips 10 is illustrated in operative position, and includes three pivotally interconnected wedge-shaped slips 12. The slips 12 can be pivoted apart to admit a tubular member, such as the illustrated drill pipe 14 or a section of casing. The slips 12 each carry serrations or teeth (not shown) on the inner side thereof for biting into and engaging the drill pipe. When the set of slips has been closed about the drill pipe or casing, they are lowered with the engaged tubular element into the hole 16 through the rotary table 18 of the drilling rig.

The slips are wedged tightly against the tubular member to maintain the drill string or casing therebelow suspended from the rotary table 18. The drill string or casing can be suspended in this location until it is desirable to add another section of drill pipe or casing during a trip into the well bore or lift the string upwardly to remove a section during a trip out of the well bore.

Each slip 12 is made of steel, is somewhat massive, and is quite heavy. To enable the slips to be handled, a set of handles 20 is employed. Each of the handles 20 can be identically shaped to the other handles, or a handle of a different shape, but constructed in accordance with the present invention can be employed. Two embodiments of the handle 20 as constructed to afford advantage in the particular context of usage for lifting and manipulating slips are shown in FIGS. 2–6.

Figure 2:
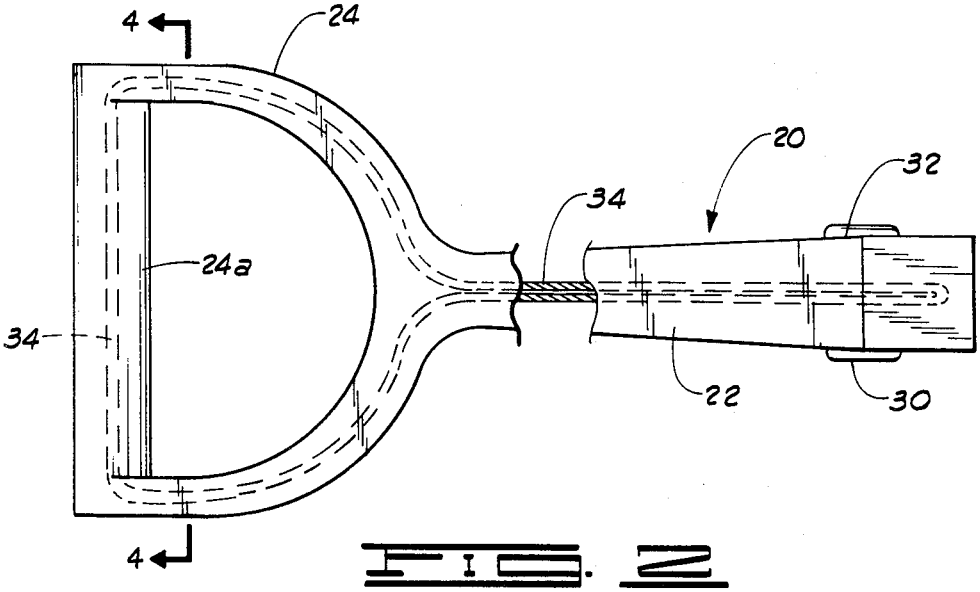
FIG. 2 is a bottom plan view of a slip handle constructed in accordance with the invention, with a part of the handle broken away, and showing in dashed lines, the stranded nylon cord forming a core within the handle.
Figure 3:
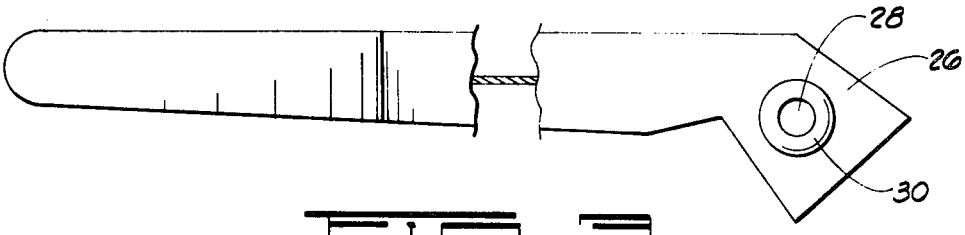
FIG. 3 is a side elevation view of the slip handle shown in FIG. 2.
Figure 4:
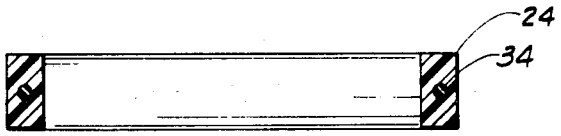
FIG. 4 is a sectional view taken along line 4—4 of FIG. 2.

In one embodiment of the invention, the slip handle 20 has the construction illustrated in FIGS. 2 and 3. Thus, each handle 20 includes an elongated shank portion 22 which terminates at one end in a hand grip loop 24. The hand grip 24 is of D-shaped configurations and includes a finger gripping bar **24*a* which projects normal to the projected axis of the shank portion 22. At its other end, the shank portion 22 terminates in a pivot head or knuckle 26 which defines an elongated pivot pin aperture 28 extending therethrough. The pivot pin aperture 28 is surrounded at its outer ends by a pair of reinforcing ridges 30 and 32**. The axis of the pivot pin aperture extends substantially parallel to the plane of the D-shaped hand grip loop.

The handle 20 as thus constituted and geometrically configured, is molded from polyurethane. This material is molded to a hardness which is relatively soft as compared to steel, and which imparts to the handle some resilience and bendability. Preferably, the polyurethane has a Shore A hardness, as determined by testing method ASTM D-2240-68 of 95±2. It has a viscosity 20 minutes after mixing of less than 4000 centipoise. The mix ratio used in preferably about 100 parts by volume of resin to about 38.8 parts by volume of catalyst. Typically, a urethane casting elastomer sold under the trademark URALITE® by Hexcel Chemical Products is employed. Embedded within the handle and extending over substantially its entire length is an elongated stranded nylon cord 34 which forms a core within the handle. The cord 34 is doubled over the length of the shank portion 22 of the handle 20 and lies substantially coincident with the longitudinal central axis of the shank portion. At the hand grip loop 24, the two parallel runs of the cord 34 diverge from each other and extend around the loop in a single run as shown in FIG. 2. At the other end of the handle 20, the cord 34 is doubled back upon itself as shown in FIG. 2.

Figure 5:
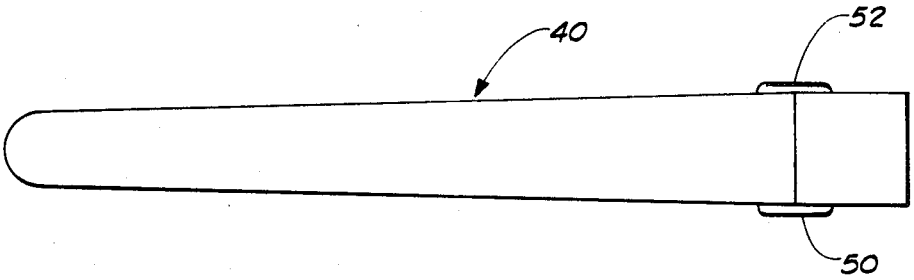
FIG. 5 is a bottom plan view of a modified embodiment of the slip handle constructed in accordance with the present invention.
Figure 6:
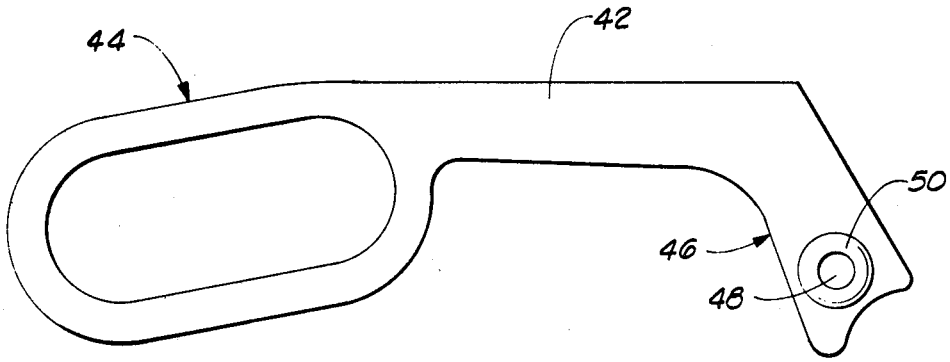
FIG. 6 is a side elevation view of the slip handle shown in FIG. 5.

Another form of slip handle 40 constructed in accordance with the invention is shown in FIGS. 5 and 6. This embodiment of the handle also includes an elongated shank portion 42 which terminates in a hand grip loop 44 at one end of the shank and a pivot head or knuckle 46 at the other end of the shank. The pivot head has an elongated pivot pin opening or aperture 48 extending therethrough, and terminating at its open opposite ends within circular ridges 50 and 52.

As in the case of the embodiment of the handle of the invention illustrated in FIGS. 1—4, the embodiment shown in FIGS. 5 and 6 incorporate the stranded nylon cord which is positioned at the central axis of the handle. The hand grip loop 44, however, is of an oval configuration and is oriented to extend in substantially coplanar alignment with the shank 42 and the pivot head 46.

The slip handles constructed in accordance with the invention are much safer to use when lifting and moving the heavy slips, and are not so unpleasant to touch where drilling is being carried out in very hot or cold climates.

Although certain preferred embodiments of the invention have been herein described in order to facilitate the construction and use of the invention by those having ordinary skill in the art to which this invention applies, it will be appreciated that various changes and innovations in the described and illustrated structure can be effected without departure from the basic principles of the invention. Changes and innovations of this type are therefore deemed to be circumscribed by the spirit and scope of the invention, except as the same may be necessarily limited by the accompanying claims, or reasonable equivalents thereof.

What is claimed is:

1. A slip structure for engaging drill pipe and the like comprising:

a plurality of hingedly interconnected slip elements positionable to surround and engage a tubular element when in a position of closure; and a pair of slip handles at opposite sides of the slip structure with the slip handles pivotally engaging two different ones of the slip elements, each of said handles comprising:

an elongated body of molded polyurethane having a stranded nylon cord extended over the length thereof and embedded in the center thereof, said polyurethane body having:

a hand grip loop at one end thereof;

a pivot head at the other end thereof; and an elongated shank portion interconnecting the loop and pivot head.

2. claim 1 wherein said stranded nylon cord is doubled within said elongated shank portion.

3. claim 1 wherein said hand grip loop is of D-shaped configuration generally lying in a plane, and said pivot head has a pivot pin aperture extending therethrough for accommodating an elongated pivot pin projected through said aperture along an axis extending parallel to the plane of said D-shaped hand grip loop.

4. claim 2 wherein said nylon cord includes a loop branching from the doubled portion thereof and extending around said hand grip loop.

5. claim 2 wherein said hand grip loop is of oval configuration generally lying in a plane, and said pivot head defines a pivot pin aperture extending therethrough for accommodating an elongated pivot pin projected through said aperture along an axis extending perpendicular to the plane of said oval hand grip loop.

6. claim 4 wherein said nylon cord includes a loop branching from the doubled portion thereof and extending around said hand grip loop.

7. A handle for lifting and moving heavy weights attached to the handle comprising:

an elongated molded body of polyurethane having a hand grip loop at one end thereof, a bifurcated pivot knuckle at the other end thereof and an elongated shank interconnecting the pivot knuckle and hand grip loop; and an elongated stranded nylon cord embedded in the polyurethane with a single course of the cord extended around the hand grip loop, and a double course of the cord extending over the length of the shank along the central axis of the shank.

8. claim 7 wherein said pivot knuckle has an elongated pivot pin aperture extending therethrough, and wherein said hand grip loop is of D-shaped configuration and lies substantially in a plane extending parallel to the axis of said pivot pin aperture.

9. claim 7 wherein said pivot knuckle has an elongated pivot pin aperture extending therethrough, and wherein said hand grip loop is of oval configuration and lies substantially in a plane extending perpendicular to the axis of said pivot pin aperture.

* * * * *